United States Patent [19]

Pardes et al.

[11] 4,397,132

[45] Aug. 9, 1983

[54] METHOD FOR MANUFACTURING A CONTAINER ASSEMBLY FOR STORING AND DISPENSING FLUID MATERIALS

[75] Inventors: Greg Pardes, New York; Richard F. Berger, Huntington; Bernard R. Gerber, Jamaica, all of N.Y.

[73] Assignee: The Reseal Container Corporation of America

[21] Appl. No.: 259,495

[22] Filed: May 1, 1981

[51] Int. Cl.[3] ..... B65B 3/16; B65B 3/24

[52] U.S. Cl. ..... 53/471; 53/470

[58] Field of Search ..... 53/468, 469, 470, 289, 53/452, 457, 471; 222/1, 335, 92, 107

[56] References Cited

U.S. PATENT DOCUMENTS

| | | | |
|---|---|---|---|
| 3,103,089 | 9/1963 | Allen | 53/289 X |
| 3,457,694 | 7/1969 | Tatibana | 53/289 X |
| 3,477,195 | 11/1969 | Chambers | 53/470 |
| 3,520,337 | 7/1970 | Irland et al. | 53/470 X |
| 4,202,470 | 5/1980 | Fujii | 53/470 X |
| 4,338,765 | 7/1982 | Ohmori et al. | 53/289 X |

*Primary Examiner*—Horace M. Culver

*Attorney, Agent, or Firm*—Toren, McGeady and Stanger

[57] ABSTRACT

A method for manufacturing a container assembly adapted to store and dispense fluid material including a collapsible flexible container adapted to be stretched from an initial nominal position and to be collapsed to dispense fluid material stored therein, and a cap member adapted to be placed in operative engagement with a neck portion of the container configured to define a dispensing flow conduit which is placed in direct flow communication with the interior of the container when the cap member is mounted in assembled position on the neck portion of the container. In the manufacture of the container assembly, the container is first stretched from its initial nominal position to expand the volume thereof, and then filled with a fluid material to be stored therein and to be dispensed therefrom while in said stretched position. The cap member is then attached to the container by connecting the cap member in operative engagement with the upper neck portion, and the container is then released from the stretched position and allowed to return to the initial nominal position whereby a quantity of fluid material stored therein commences to be emitted from a check valve at the outlet end of the dispensing flow conduit thereby to completely fill the dispensing flow conduit in the cap member with the fluid material to be dispensed.

9 Claims, 3 Drawing Figures

METHOD FOR MANUFACTURING A CONTAINER ASSEMBLY FOR STORING AND DISPENSING FLUID MATERIALS

The present invention relates generally to an article of manufacture and more particularly to a container assembly which may be utilized to store and dispense fluid materials.

More specifically, the invention is directed toward a method for manufacturing such a container assembly.

Container assemblies of the type to which the present invention relates may be used to store and dispense materials which are fluid in nature and which may be caused to flow during the dispensing process by application of pressure to the container. Materials of the type which may be stored and dispensed with the container assembly of the invention are, for example, syrups of all types, toothpaste, shampoo, peanut butter, catsup, mustard and the like. However, it should be understood that the container assembly of the invention is not limited to use with pasty, highly viscous materials of this type and may also be utilized to dispense liquids such as concentrated solutions of edible products.

A significant problem which is encountered in the storage of materials with which the present invention may be used is the fact that the stored product may spoil as a result of exposure to the air or surrounding atmosphere. Containers known in the prior art will usually not provide a sufficient seal in an automatic manner after a quantity of the product has been dispensed. Furthermore, such prior art containers will usually require storage space equal to the initial volume of the container, even when the container is partially or almost completely empty.

A further problem which may be experienced with prior art containers is the tendency of the contents of the container to drip and spill whereby the dispensing process becomes messy and difficult to accomplish. Also, in many types of prior art devices, a substantial amount of material may remain within the container which cannot be dispensed so that waste may occur. Particularly, if the entire contents of the container cannot be fully discharged therefrom, a considerable amount of material will remain in the discarded container giving rise to such waste.

The present invention is directed toward a method of manufacturing a container assembly which eliminates the drawbacks discussed above. The container assembly to which the present invention relates is capable of maintaining fluid materials such as foodstuffs in the interior of the container out of contact with the atmosphere thereby protecting the material against spoilage.

The container assembly to which the invention is related operates so that it remains normally closed to maintain the contents sealed from the atmosphere while enabling ready and convenient discharge of the contents upon compression of the container.

As a result of the construction of the container assembly, substantially all of the contents may be discharged from the interior of the container before the container is discarded.

SUMMARY OF THE INVENTION

Briefly, the present invention may be described as a method of manufacturing a container assembly adapted to store and dispense fluid material, the container assembly including a collapsible resilient container adapted to be collapsed from an initial expanded position to a collapsed position, the container being adapted to contain therein the fluid material to be stored and dispensed with dispensing of the fluid material being effected by compression of the collapsible container from the initial expanded position toward the collapsed position. The container is formed with an upper neck portion structured as part of the container and with a lower grip portion.

A cap member adapted to be placed in operative engagement with the neck portion of the container is configured to define a dispensing flow conduit which is placed in direct flow communication with the interior of the container when the cap member is mounted in assembled position on the neck portion of the container. Check valve means mounted in the cap member are located at the outlet end of the dispensing flow conduit to enable fluid flow therethrough in one direction only. The check valve means are of the type which are normally closed and which operate in automatic response to increased pressure in the fluid material in the container when the container is compressed to open the dispensing flow conduit thereby permitting flow of dispensed fluid therethrough during collapsing of the container. When compression of the container is terminated, the check valve means will automatically respond by returning to their normally closed position thereby sealing the dispensing flow conduit to prevent spoilage or contamination of the contents of the container. In accordance with the present invention, the container assembly is manufactured by a method which comprises the steps of stretching the container to expand the volume thereof, filling the container with a fluid material to be stored therein and to be dispensed therefrom, attaching said cap member to the container by connecting the cap member in operative engagement with the upper neck portion thereof, and releasing and partially collapsing the container until a quantity of fluid material stored therein commences to be emitted from the check valve means thereby to completely fill the dispensing flow conduit in the cap member with the fluid material to be dispensed.

In a preferred embodiment of the invention the cap member is permanently sealed on the container and due to the manufacturing method of the invention, whereby all residual air is displaced from the interior of the container, contamination of the stored contents is effectively avoided.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE PREFERRED EMBODIMENTS

Figure 1:
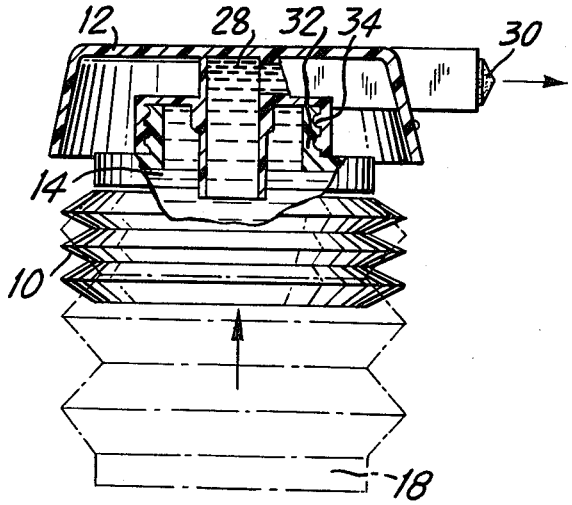
FIG. 1 is a side elevation partially in section depicting a container assembly of the type manufactured by the present invention.

Referring now to the drawings, it will be seen that the container assembly of the invention is basically formed of two primary members which are a container 10 and a cap member 12. The container 10 may be constructed of any desired plastic material such as polyvinyl chloride, polyethylene, or the like. The material from which the container 10 is formed is flexible and will also display resilient characteristics.

As will be apparent from the drawings, the container 10 is shaped in the form of a bellows. However, other forms of resilient collapsible containers may be used. Fluid material 14 may be stored in the container 10 and the fluid material may be dispensed through the cap member 12, in a manner to be described hereinafter, by applying pressure to the cap member 12 in order to compress the container 10. As the container 10 is compressed, the container will collapse as a result of its configuration as a bellows and the pressure of the fluid material within the container will increase thereby providing a force for dispensing the fluid from the container.

It will be apparent that as the container 10 is compressed, it will further collapse until it reaches a fully collapsed position whereupon all of the fluid material stored within the container will be dispensed.

The present invention is particularly directed toward a method for manufacturing the container assembly whereby the cap member 12 is attached with the container 10 and whereby the overall container assembly is caused to undergo a process in order to place the overall assembly in a condition ready for sale to an ultimate user.

The method of the invention will be described with particular reference to FIG. 2, wherein the container 10 is shown as formed with an upper neck portion 16 and with a lower grip portion 18.

Figure 2:
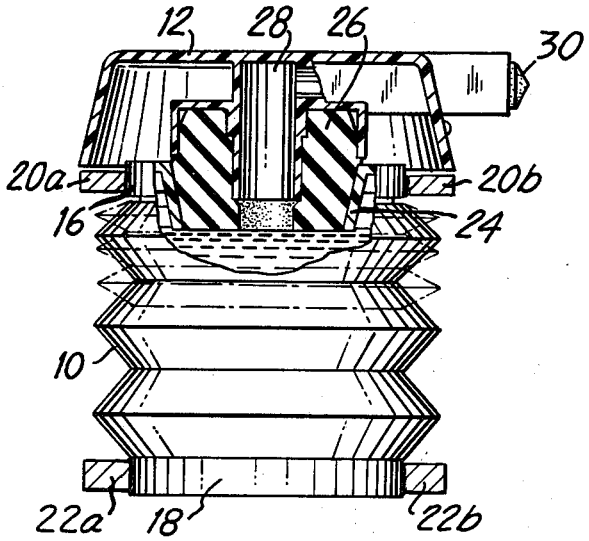
FIG. 2 is a side elevation partially broken away and partially in section showing another container assembly and depicting the manner in which the method of the present invention may be utilized.

During the process of manufacture of the container assembly shown in FIG. 2, the neck portion 16 is gripped by a pair of upper arms 20*a* and 20*b* and the lower grip portion 18 is gripped by a pair of lower arms 22*a* and 22*b*. The arms 20*a*, 20*b* and 22*a*, 22*b* are moved apart in order to resiliently stretch the container 10 thereby to increase the internal volume thereof.

This process is performed before the cap member 12 is placed in position upon the container 10 and thus during the time that the container 10 is stretched in the manner described above the neck portion 16 will define internally thereof an open filling orifice delimited by an inner circular wall 24 of the neck portion 16.

With the container 10 in the stretched position, depicted in FIG. 2, and with the cap member 12 removed, the container 10 is filled with fluid through the filling orifice defined by the wall 24.

Since the container 10 is in an expanded condition, a greater volume of liquid may be filled into the container than would otherwise be possible with the container in its unstretched state.

After the container 10 is filled and while it is still held in the stretched position by the arms 20*a*, 20*b* and 22*a*, 22*b*, the cap member 12 is placed in sealing position in the neck portion 16 as shown in FIG. 2.

Subsequently, the neck portion 16 and the grip portion 18 are released by the arms 20*a*, 20*b* and 22*a*, 22*b* and the container returns to its original unstretched position depicted in dotted line form in FIG. 2.

In the embodiment shown in FIG. 2, the cap member 12 is formed with an inner cap portion 26 which has a frustoconical annular configuration matching the configuration of the inner wall portion 24 of the neck portion 16 and adapted to be placed in press-fitted engagement within the wall 24 during the assembly procedure of the method of the invention. The inner cap portion 26, when placed in assembled position on the container 10, will serve to seal the filling opening defined by the wall 24.

The cap member 12 is formed with an inner configuration which is arranged to define a dispensing flow conduit 28 arranged in flow communication with the interior of the container 10 when the cap member 12 is mounted in operative engagement within the neck portion 16 of the container 10. The dispensing flow conduit 28 extends from an innermost part thereof in direct flow communication with the interior of the container 10 to an outlet portion thereof wherein there is mounted a check valve unit 30. The check valve unit 30 at the outlet end of the dispensing flow conduit 28 is arranged so that it will permit flow in one direction only as indicated by the arrow in FIG. 1. The check valve unit 30 is of the type which is normally closed. However, the valve unit 30 will respond to increases in internal fluid pressure in the container 10, which will occur when the container is compressed, in order to open and permit fluid flow therethrough outwardly of the flow conduit 28. However, when compression of the container 10 is alleviated, thereby reducing the internal fluid pressure thereof, the valve unit 30 will automatically close, i.e., it will return to its normally closed condition, thereby sealing the interior of the container 10 and the conduit 28 to prevent contamination of the contents of the container assembly.

Thus, when the container 10 is released by the arms 20*a*, 20*b* and 22*a*, 22*b*, fluid which has been filled into the container will flow into the conduit 28 and through the check valve 30 until the container 10 returns to its normal unstretched position shown in dotted line in FIG. 2.

As a result, during the manufacturing and filling process of the present invention, all the air will be automatically displaced from the interior of the container 10, and the entire container assembly, including the conduit 28, will be filled with liquid.

In the embodiment of FIG. 1, the cap member 12 is also constructed with an interior part thereof which defines a dispensing flow conduit 28 having a check valve unit 30 mounted at the outlet end thereof, in a manner similar to that described in connection with the embodiment of FIG. 2.

In accordance with the method of the present invention, the container assembly depicted in FIG. 1 is manufactured and filled in a manner similar to that described in connection with FIG. 2. The fluid material 14 which is to be stored and dispensed is filled into the container 10 before the cap member 12 is mounted in operative engagement with the container 10. Thus, with the container in the uncapped condition, the fluid material 14 may be inserted into the container in any appropriate manner.

After the container 10 has been filled with the fluid material to be stored and dispensed, the cap member 12 is attached onto the neck portion 16 of the container 10. However, in the embodiment of FIG. 1, the neck portion 16 is formed with external threads 32 which are adapted to be engaged by internal threads 34 formed in the cap member 12.

In the embodiment of FIG. 1, connection of the cap member 12 will be effected by placing the internal portion of the cap member 12 about the neck portion 16 of the container 10. By rotating the cap member 12, the screw threads 32 and 34 will become engaged with each other and the cap member 12 may be screwed in fluid-tight engagement onto the container 10.

It will be apparent that, with regard to the embodiments of FIGS. 1 and 2, the basic step of ensuring filling of the fluid flow conduit will be the same, with the basic difference between the two embodiments being that in the embodiment of FIG. 1, a screw-threaded engagement is provided between the neck portion 16 and the cap member 12, while in the embodiment of FIG. 2, a press fit is provided between the resilient stopper 26 and the neck portion 16 of the container 10.

Since with the process of the present invention, the engire internal volume of the container assembly will be totally devoid of air, potential contamination of the contents of the container will be avoided by steps which may be taken at the manufacturing and filling site.

In cases where a permanently sealed container assembly is desired, adhesive may be applied between the threads 32 and 34 in the embodiment of FIG. 1 in order to permanently seal the cap member 12 on the container 10.

Figure 3:
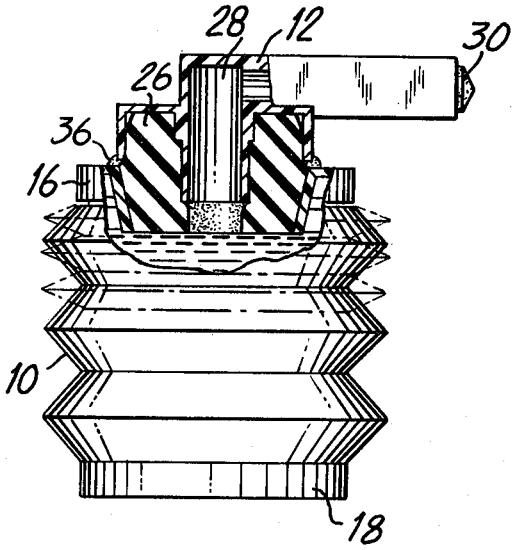
FIG. 3 is a side elevation partially broken away and partially in section showing another embodiment with which the method of the invention may be utilized.

In a permanently sealed assembly of the type depicted in FIG. 3, a weld 36 is formed between the cap member 12 and the neck portion 16. Different attachment methods may be used such as, for example, ultrasonic welding or spin-welding and the cap member may also be attached by heat sealing with the use of electromagnetic energy, i.e. microwave irradiation or by the use of lasers.

It will be understood, of course, that the assembly depicted in FIG. 3, may also be produced by the method described with reference to FIG. 2 whereby the entire internal volume of the assembly is automatically filled with liquid during the manufacturing and filling process.

While specific embodiments of the invention have been shown and described in detail to illustrate the application of the inventive principles, it will be understood that the invention may be embodied otherwise without departing from such principles.

What is claimed is:

1. A method for manufacturing a container assembly for storing and dispensing fluid material, said container assembly including: a collapsible resilient container adapted to be stretched and collapsed from an initial nominal position; said container being adapted to contain therein said fluid material to be stored and dispensed with dispensing of said fluid material being effected by compression of said collapsible container from said initial nominal position toward said collapsed position to diminish the internal volume thereof; an upper neck portion formed as part of said container; a lower grip portion; a cap member adapted to be placed in sealing engagement with said neck portion, said cap member defining a dispensing flow conduit which is in direct flow communication with the interior of said container when said cap member is placed in sealing engagement with said neck portion; and check valve means mounted in said cap member located at the outlet end of said dispensing flow conduit to enable fluid flow therethrough in one direction only, said check valve means being normally closed and operating to automatically respond to increased pressure in the fluid material in said container when said container is compressed to open said dispensing flow conduit to permit flow of dispensed fluid therethrough during collapsing of said container and to automatically respond to cessation in the compressing of said container to return to said normally closed condition to seal said dispensing flow conduit; said method comprising the steps of gripping said container about said neck portion and said lower grip portion, stretching said container from said initial nominal position to increase the internal volume thereof, filling said container with a fluid material to be stored therein and dispensed therefrom, attaching said cap member to said container by connecting said cap member in operative engagement with said upper neck portion after said container has been filled with said fluid material, and thereafter releasing said neck portion and said lower grip portion of said container to allow said container to return to said initial nominal position whereby a quantity of the fluid material stored therein is caused to be emitted from said check valve means thereby to completely fill said dispensing flow conduit in said cap member with said fluid material to be dispensed.

2. A method according to claim 1 wherein said cap member is attached to said upper neck portion by screw-threaded engagement therewith.

3. A method according to claim 1 wherein said cap member is attached to said upper neck portion by having a part of said cap member placed in press fitted engagement with said upper neck portion.

4. A method according to claim 1, wherein said container is formed as a flexible resilient bellows.

5. A method according to claim 1 wherein said cap member is adhesively connected with said container.

6. A method according to claim 1, wherein said cap member is welded to said container.

7. A method according to claim 6 wherein said welding is performed by one of ultrasonic welding or spin welding.

8. A method according to claim 1 wherein said cap member is heat sealed to said container by use of electromagnetic energy.

9. A method according to claim 8 wherein said heat sealing is performed by one of microwave irradiation and lasers.

* * * * *